United States Patent [19]

Defilippi et al.

[11] 3,933,479

[45] Jan. 20, 1976

[54] VANADIUM STABILIZED MARTENSITIC STAINLESS STEEL

[75] Inventors: Joseph D. Defilippi, Allegheny Township, Westmoreland County; George A. Ratz, Allegheny County, both of Pa.

[73] Assignee: United States Steel Corporation, Pittsburgh, Pa.

[22] Filed: Oct. 10, 1974

[21] Appl. No.: 513,699

[52] U.S. Cl. ..... 75/128 V; 148/37 X

[51] Int. Cl.[2] ..... C22C 38/46

[58] Field of Search ..... 75/126 E, 128 V, 128 T; 148/37

[56] References Cited

UNITED STATES PATENTS

| | | | |
|---|---|---|---|
| 2,193,222 | 3/1940 | Browne | 75/128 V |
| 2,905,577 | 9/1959 | Harris | 75/126 E |
| 3,288,611 | 11/1966 | Lula et al. | 148/142 X |
| 3,316,085 | 4/1967 | Grundman et al. | 148/37 X |
| 3,658,514 | 4/1972 | Lula et al. | 75/128 T |
| 3,834,897 | 9/1974 | Nevalainen | 75/124 |

*Primary Examiner*—R. Dean
*Assistant Examiner*—Arthur J. Steiner
*Attorney, Agent, or Firm*—Forest C. Sexton

[57] ABSTRACT

A martensitic stainless steel having an excellent combination of strength and toughness containing
0.01 to 0.15% carbon,
10 to 13% chromium,
2.0 to 5.0% nickel, and
0.05 to 0.20% vanadium.

3 Claims, 5 Drawing Figures

VANADIUM STABILIZED MARTENSITIC STAINLESS STEEL

BACKGROUND OF THE INVENTION

In recent years the use of high-strength martensitic stainless steels for light structural applications in the transportation industry has increased markedly. In this application, the toughness or resistance of the steel to catastrophic crack propagation is an important property. This has led to development of low-carbon martensitic grades (less than about 0.05% C) with good notch toughness.

One of the steels considered for the above application is a low carbon, 0.03% max., martensitic stainless steel containing 12% chromium, 4% nickel and 0.4% titanium. See for example U.S. Pat. No. 2,397,997, Whyche et al.; and U.S. Pat. No. 3,288,611, Lula et al. These steels are air hardening and can be tempered to various combinations of strength and toughness. Metallurgically, the titanium in the above steel is added to serve as a strong carbide former to tie-up carbon and nitrogen and ensure a low interstitial (essentially interstitial free) martensitic microstructure with good toughness. Nickel is added to prevent delta ferrite formation at high temperatures since such ferrite is deleterious to the toughness of martensitic stainless steels. Although the commercial composition of such steels may of course vary somewhat, the above recited specific composition is claimed to the optimum for achieving an excellent combination of strength and toughness with the leanest possible alloy content in a low carbon martensitic steel.[1]

[1] G. N. Aggen, C. M. Hammond, and R. A. Lula, "New Martensitic Stainless Steels", Advances in the Technology of Stainless Steels and Related Alloys, ASTM Special Technical Publication 369, Philadelphia, pp. 40–46.

SUMMARY OF THE INVENTION

This invention is predicated upon our conception and development of a somewhat superior low-carbon 12% chromium martensitic stainless steel which is achieved by an even leaner alloy content. This is made possible by utilizing vanadium instead of titanium as the carbide formers which permits lesser amounts of nickel to be effective in preventing delta ferrite formation.

Accordingly, an object of this invention is to provide a new 12% chromium martensitic stainless steel having an excellent combination of strength and toughness with an exceptionally lean alloy content.

Another object of this invention is to provide an air hardenable martensitic stainless steel which can be tempered to various combinations of strength and toughness having a lower than normal nickel content.

A further object of this invention is to provide a new and useful martensitic stainless steel containing approximately 12% chromium, 3% nickel and 0.15% vanadium.

DESCRIPTION OF THE PREFERRED EMBODIMENT

As noted above, 4% nickel and 0.4% titanium is claimed to be the leanest alloy content possible in this class of 12% martensitic stainless steel to achieve the desired microstructure, and hence a good combination of strength and toughness. At least 0.4% titanium is necessary to tie-up the carbon and nitrogen and thus ensure a low interstitial martensite. Since the carbon and nitrogen are effectively inactivated, nickel is the only element available to prevent the formation of the deleterious delta ferrite. That is to say, the titanium removes from solid solution the two elements, carbon and nitrogen, that most effectively prevent ferrite formation. Therefore, to prevent ferrite formation, a larger than usual amount of nickel must be added, i.e., at least 4%.

The crux of this invention is a development of a similar but modified stainless steel wherein the carbon and nitrogen are stabilized with vanadium rather than titanium. The carbides and nitrides of vanadium are more soluble in stainless steel than those of titanium over the temperature range in which solidification occurs. Accordingly, in the alloy of this invention containing vanadium instead of titanium, the carbon and nitrogen remain in solution during solidification and are subsequently precipitated as carbides and nitrides of vanadium in solid solution at lower temperatures after solidification is complete to thus assure a lower interstitial martensite after tempering. Since the carbon and nitrogen are in solid solution during solidification, these elements will serve to prevent the formation of delta ferrite, and hence, a lesser amount of nickel need be added for this purpose, i.e., about 3% nickel.

In addition to the above mentioned distinctions, the weaker carbide forming element, i.e., vanadium, does not remove all of the carbon from solid solution, but rather the composition is adjusted so that some carbon remains in solution to improve strength. In addition to the above advantages, the stainless steel of this invention, as compared to the prior art titanium stabilized steel, is capable of exhibiting higher yield and tensile strengths and superior notch tougness values. This steel is further distinguishable in having a higher initial hardness and a substantially smaller aging response.

Table I below provides the broad and preferred composition ranges for the stainless steel of this invention.

TABLE I

| Composition Limits for the Steel of this Invention | Broad | Preferred |
|---|---|---|
| Carbon | 0.01 – 0.15% | 0.03 – 0.05% |
| Silicon | 1.00% max. | 0.15 max. |
| Chromium | 10 – 13% | 10.75–11.5% |
| Nickel | 2.0 – 5.0% | 3.0 – 3.5% |
| Vanadium | 0.05 – 0.20% | 0.12–0.18% |

Figure 1:
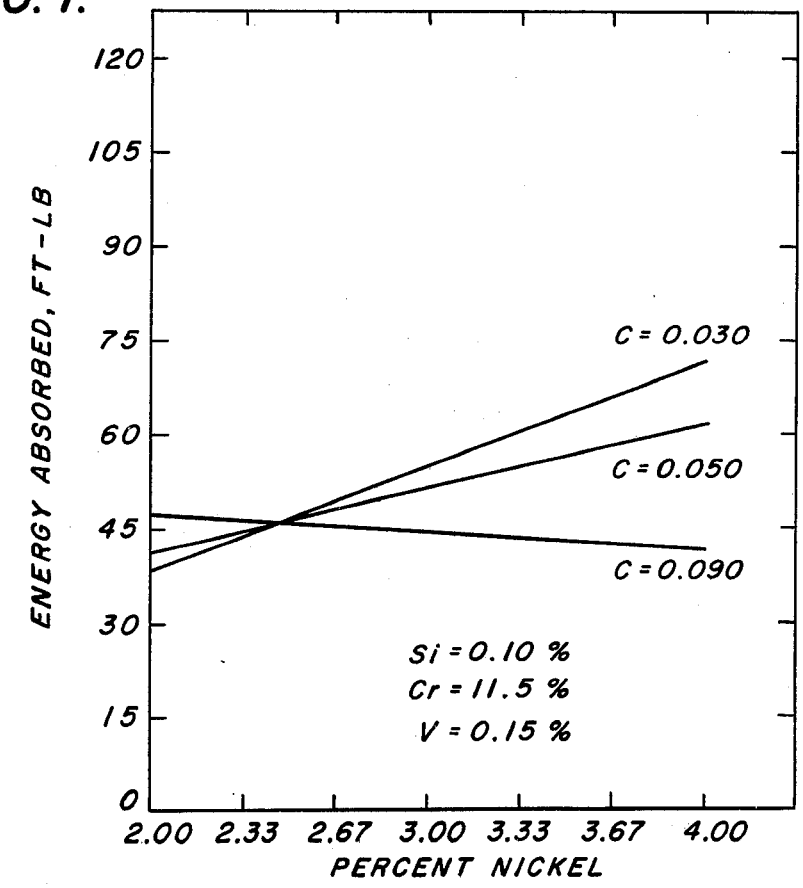
FIG. 1 is a graph illustrating the effect of nickel on Charpy V-Notch toughness at 80°F of three annealed steels of this invention having different carbon contents.

In order to achieve good high strength values, it is desirable to have some carbon in solid solution. This is accomplished by assuring a minimum of at least 0.01% carbon in the steel, and assuring that not all of the carbon is removed from solid solution. To this end then, vanadium is essential as compared to the stronger carbide formers such as titanium, columbium or zirconium. The results shown in FIGS. 1 and 4 indicates that increasing the carbon content does cause a comparable decrease in toughness in both the annealed and tempered conditions. Therefore, although some carbon in solid solution is desired for strength purposes, its amount should be maintained relatively low, i.e., below 0.15% and preferably below 0.05%. Within this range, carbon will be responsible for an appreciable improvement in strength values while toughness values are not significantly effected.

Figure 2:
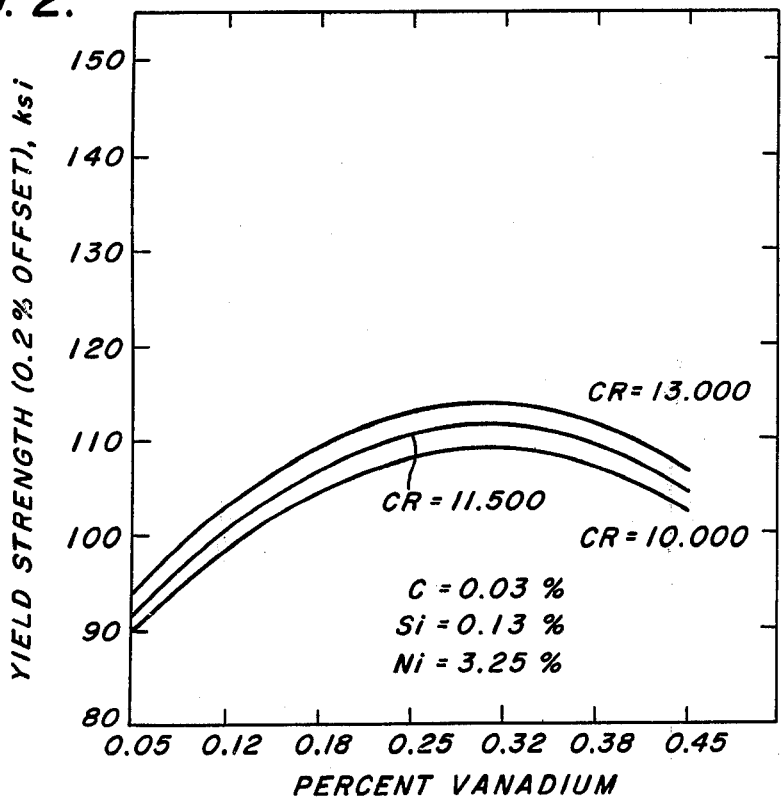
FIG. 2 is a graph illustrating the effect of vanadium on yield strength of three annealed steels of this invention having different chromium contents.
Figure 3:
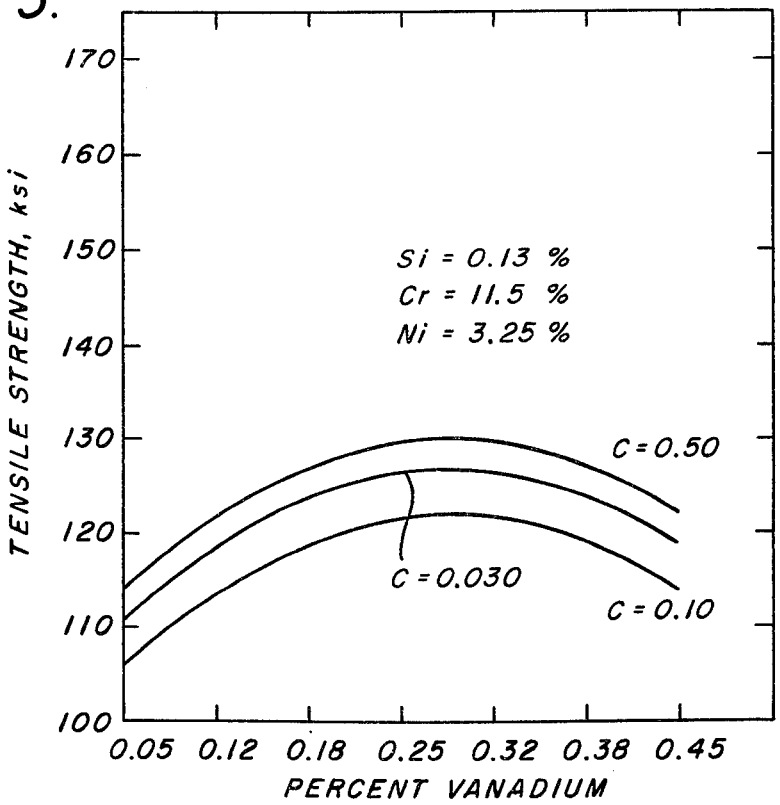
FIG. 3 is a graph illustrating the effect of vanadium on yield strength of three annealed steels of this invention having different carbon contents.
Figure 4:
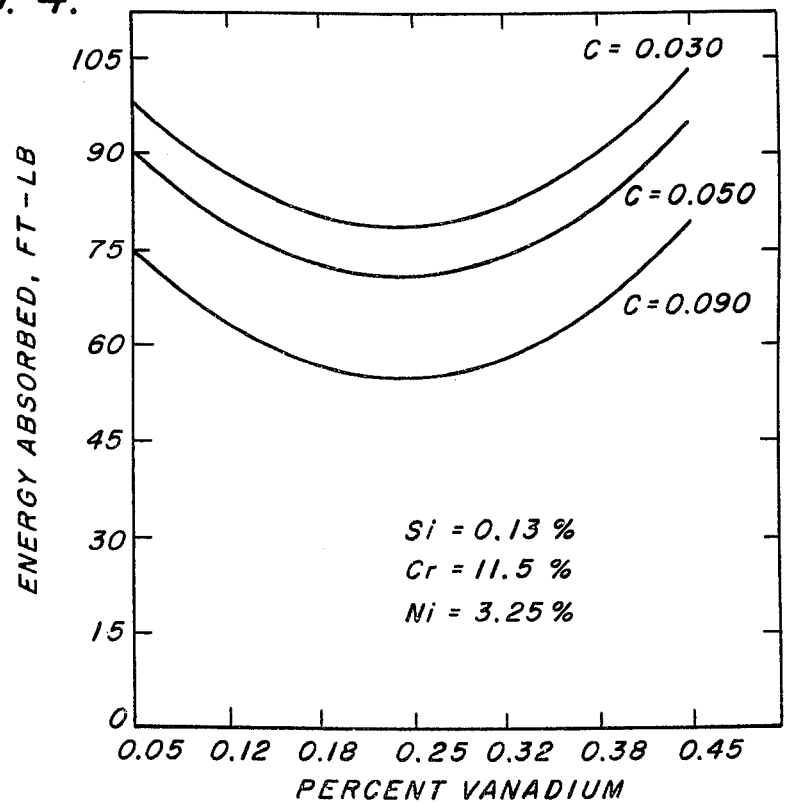
FIG. 4 is a graph illustrating the effect of vanadium on Charpy V-Notch toughness at 80°F of three annealed steels of this invention having different carbon contents.

The effect of vanadium on the yield and tensile strength on the inventive steel in the tempered condition are shown in FIGS. 2 and 3, and indicate a peak in each strength value at about 0.25% vanadium. As shown in FIG. 4, a minimum in the toughness value occurs at about the same vanadium content. Accordingly, good combinations of strength and toughness properties can be achieved by working away from the 0.25% vanadium content, i.e., at from 0.05–20% vanadium or 0.30–0.45% vanadium. As shown in FIG. 2, for steel with a preferred carbon content of 0.03% about 0.12% vanadium is needed to maintain a 100 ksi minimum yield strength in the tempered condition for a steel with a minimum chronium content of 10.75%. Because of the cost of vanadium, it is of course desirable to keep vanadium as low as possible, and hence this invention contemplates only the lower useful vanadium range of 0.12 to 0.02%. In contrast to the prior art titanium stabilized steel, it should be noted that the vanadium-to-carbon ratio is less than 8. Although equally good strength and toughness values could be obtained with vanadium contents in the 0.30–0.45% range, such a steel would be considerably more expensive and yet no better. In addition, such a steel would have to have a higher chromium content as will be explained below.

Figure 5:
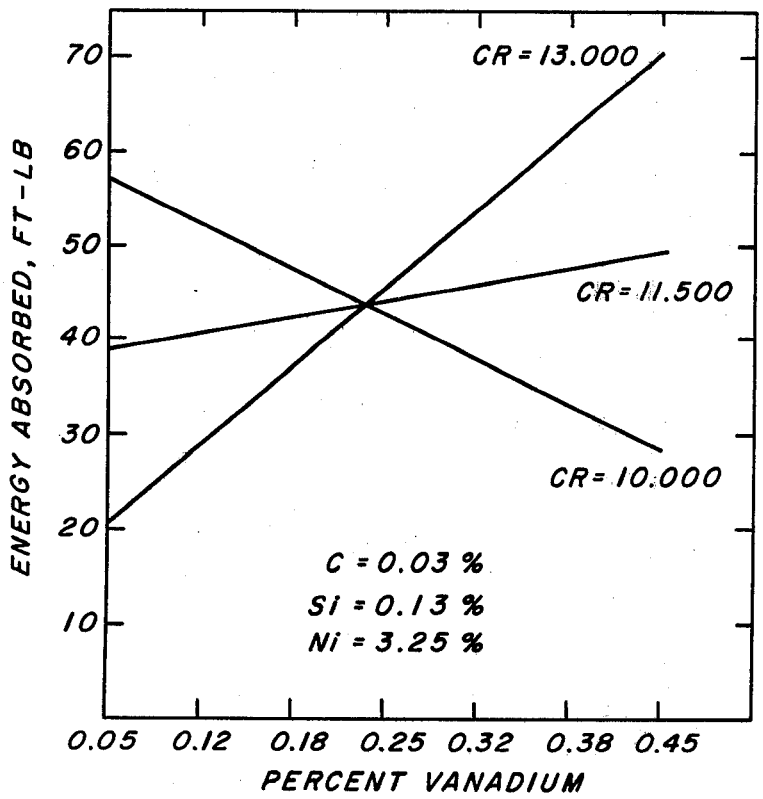
FIG. 5 is a graph illustrating the effect of vanadium on Charpy V-Notch toughness at 0°F of three steels of this invention having different chromium contents.

The results shown in FIG. 5 indicate the economic desirability of melting to a preferred 0.12–0.18% vanadium range and indicate an interrelationship between vanadium content and chromium content. These results show that for best toughness, the vanadium should be in the lower range, i.e., below 0.25% when chromium is in the low range, i.e., 10.0–11.5%, and visa versa. Accordingly, it is economically advantageous to have the vanadium content low so that the chromium content can be kept low thereby insuring good toughness characteristics. For corrosion resistance considerations, the chronium content should be at least 10% and preferably 10.75%.

As noted above, the nickel content is essential for preventing delta ferrite formation during solidification. In the prior art titanium stabilized steels, at least 4% nickel is necessary for this purpose. It is well known however that nickel has an adverse affect on yield strength, and hence the amount of nickel should be minimized. In this inventive steel the carbon and nitrogen remain in solid solution during solidification, and these two elements are well known to inhibit ferrite formation. Because of this, a lesser amount of nickel is necessary in this inventive steel, i.e., at least about 2.0% nickel for a 50% reduction.

In so far as residual elements are concerned, these are not particularly harmful if kept within their usual residual limits for stainless steels. Specifically, the residual contents should be 1.00% maximum manganese, 0.04% maximum phosphorus, 0.03% maximum sulfur, and 1.00% maximum silicon and preferably less than 0.15% silicon.

To verify the above phenomenon, a total of 32 additional heats were prepared, processed and examined. The chemistry of each heat was modified somewhat in order to establish compositional limits. Basically, only the elements carbon, silicon, chromium, nickel and vanadium were varied for study as these obviously were those which would exert the greatest influence on the structure and mechanical properties of the steel. For purposes of brevity, the analysis of each of the 32 heats will not be presented here. Table II below does however, show the general level of compositions studied.

TABLE II

Elements and Their Levels Studies In 32 Experimental Steels

| Level | %C | %Si | %Cr | %Ni | %V |
|---|---|---|---|---|---|
| Very Low | <0.01 | 0.03 | 10.00 | 2.0 | 0.05 |
| Low | 0.03 | 0.11 | 10.75 | 2.5 | 0.15 |
| Medium | 0.06 | 0.19 | 11.50 | 3.0 | 0.25 |
| High | 0.09 | 0.27 | 12.25 | 3.5 | 0.35 |
| Very High | 0.12 | 0.35 | 13.00 | 4.0 | 0.45 |

The balance of the above heats contained 0.3% Mn, 0.035% N plus normal residuals.

Each of the 32 heats were hot rolled to ½-inch plate, with a portion of each plate reheated to 2100°F and then rolled to 0.150-inch sheet. The plates and sheets were air annealed for ½ hour at 1,650°F (one at 1,700°F) and air cooled. Portions of each plate and sheet were tempered for 4 hours at 1,150°F.

Again in the interest of brevity, the test results for each heat will not be presented here. The effect of very low and high levels of each major element by itself and in combination with each other element on the mechanical properties was studied. From these studies, a multi-dimensional-response was plotted and an equation derived for each property. The composition effects on the longitudinal tensile properties can be defined by the following two equations.

$$\text{Yield Strength (0.2\% Offset) ksi} = 91.5 + 65.9\,(\%C) + 1.5\,(\%Cr) - 2.0\,(\%Ni) + 25.5\,(\%V) - 304.4\,(\%V - 0.26)^2$$

$$\text{Tensile Strength ksi} = 91.6 + 112.0\,(\%C) + 1.7\,(\%Cr) + 2.8\,(\%Ni) + 16.1\,(\%V) - 1840.7\,(\%C - 0.054)^2 - 286.5\,(\%V - 0.26)^2$$

The composition effects on the transverse Charpy V-notch toughness for the steels in the annealed condition can be defined by the following equations:

$$\text{Energy absorbed at 80°F, ft.-lb.} = 67.6 - 166.8\,(\%C) - 89.0\,(\%Si)$$

-continued

| | | | |
|---|---|---|---|
| | | +0.3 | (%Ni) |
| | | −320.5 | (%C - 0.054) (%Ni - 2.98) |
| | | −80.8 | (%Si - 0.205) (%Ni - 2.98) |
| Energy absorbed at 0°F, ft.-lb. | = | 4.9 | |
| | | +48.8 | (%C) |
| | | −80.0 | (%Si) |
| | | +1.6 | (%Cr) |
| | | +7.9 | (%Ni) |
| | | +26.4 | (%V) |
| | | −343.7 | (%C - 0.054) (%Ni - 2.98) |
| | | −94.0 | (%Si - 0.205) (%Ni - 2.98) |
| | | +65.1 | (%Cr - 11.5) (%V - 0.26) |
| Energy absorbed at −50°F, ft.-lb. | = | 3.0 | |
| | | +163.9 | (%C) |
| | | −44.0 | (%Si) |
| | | +5.8 | (%Ni) |

The composition effects on the transverse Charpy V-notch toughness for the steels in the annealed and tempered condition can be defined as follows:

| | | | |
|---|---|---|---|
| Energy absorbed at 0°F, ft.-lb. | = | −29.4 | |
| | | −100 | (%Si) |
| | | +26.2 | (%Ni) |
| | | +1005.7 | (%Si - 0.205) |
| | | −143.3 | (%Si - 0.205) (%Ni - 2.98) |
| Energy absorbed at −50°F, ft.-lb. | = | 57.1 | |
| | | −59.9 | (%Si) |
| | | +38.4 | (%Ni) |
| | | +696.5 | $(\%Si)^2$ |
| | | −95.4 | (%Si) (%Ni) |

To summarize the results noted in the above mentioned tests, it was clearly noted that increasing the carbon and chromium contents linearly increased the steel's yield strength in the annealed and tempered condition, whereas increasing nickel contents decreased yield strength linearly. Vanadium has quadratic as well as a linear effect on yield strength. In essence however, increasing vanadium contents will increase yield strength markedly up to about 0.25% vanadium. The significance of vanadium is noted by the fact that of all the 32 experimental heats, only one displayed a yield strength of less than 100 ksi. This was a steel containing a very low level of vanadium.

As expected, increasing carbon and nickel contents linearly increases the steel's toughness at −50°F in the annealed condition, whereas silicon linearly decreases toughness. In the annealed and tempered condition however, only silicon and nickel have a major effect on toughness at −50°F. At 0.13% Si, an increase in nickel from 2.5 to 3.5% will result in a predicted 24 ft.-lb. increase in energy absorbed by a transverse specimen at −50°F. On the other hand at 0.25% silicon, the increase is only 12 ft.-lb. for the same change in nickel content. For optimum toughness therefore, silicon should be as low as economically possible.

To further exemplify the subject invention, an 80-ton commercial heat was produced and processed to ½-inch plate. The composition of this heat was as follows:

| C | Mn | P | S | Si | Cr | Ni | V | N |
|---|---|---|---|---|---|---|---|---|
| 0.051% | 0.24% | 0.018% | 0.013% | 0.04% | 11.24% | 3.12% | 0.18% | 0.033% |

In the annealed and tempered condition, the 2½'-inch plate exhibited the following properties:

| Orientation | Yield Strength (0.2% Offset) ksi | Tensile Strength ksi | Elongation (in 2 inches) % | Charpy-V-Notch Energy absorbed ft.-lb. | | |
|---|---|---|---|---|---|---|
| | | | | 70°F | 0°F | −50°F |
| Longitudinal | 103.3 | 129.6 | 16 | 80 | 48 | 28 |
| Transverse | 106.6 | 126.5 | 14 | 59 | 30 | 23 |

We claim:

1. A martensitic stainless steel having an excellent combination of strength and toughness consisting essentially of 0.01 to 0.15% carbon, 1.00% maximum silicon, 10 to 13% chromium, 2.0 to 5.0% nickel, 0.05 to 0.20% vanadium, and a remainder of iron and normal residual impurities.

2. A martensitic stainless steel according to claim 1 in which the vanadium content is from 0.12 to 0.18%.

3. A martensitic stainless steel according to claim 2 in which the carbon content is from 0.03 to 0.05%, the silicon content is no more than 0.15%, the chromium content is from 10.75 to 11.5% and the nickel content is from 3.0 to 3.5%.

* * * * *